US011419462B2

(12) United States Patent
Wolf et al.

(10) Patent No.: US 11,419,462 B2
(45) Date of Patent: Aug. 23, 2022

(54) WIPES DISPENSING NOZZLES HAVING WEAR INDICATORS AND WIPES DISPENSERS HAVING THE SAME

(71) Applicant: GOJO Industries, Inc., Akron, OH (US)

(72) Inventors: Kaitlin Anne Wolf, Kent, OH (US); Shelby Jay Buell, Medina, OH (US); Christopher James Mann, Hudson, OH (US); Janice Lynn Moore, Akron, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 16/804,101

(22) Filed: Feb. 28, 2020

(65) Prior Publication Data

US 2020/0281421 A1 Sep. 10, 2020

Related U.S. Application Data

(60) Provisional application No. 62/814,990, filed on Mar. 7, 2019.

(51) Int. Cl.

| | |
|---|---|
| ***A47K 10/36*** | (2006.01) |
| ***G07F 11/00*** | (2006.01) |
| ***G07F 11/44*** | (2006.01) |

(52) U.S. Cl.

CPC ..... *A47K 10/3643* (2013.01); *G07F 11/005* (2013.01); *G07F 11/44* (2013.01)

(58) Field of Classification Search

CPC ... A47K 10/3643; G07F 11/005; G07F 11/44; B41F 31/07

USPC ..... 221/22

See application file for complete search history.

(56) References Cited

U.S. PATENT DOCUMENTS 2,102,784 A * 12/1937 Bridges ..... B60C 11/24 264/246
3,578,055 A * 5/1971 French ..... B60C 11/24 116/208
4,863,027 A * 9/1989 Yano ..... A47K 10/3818 206/390

(Continued)

FOREIGN PATENT DOCUMENTS

DE 102016004989 A1 * 10/2017 ..... B66C 13/46
FR 2909346 A1 * 6/2008 ..... B60S 1/3801

(Continued)

OTHER PUBLICATIONS

Invitation to Pay Additional Fees from PCT/US20/20632 dated May 27, 2020.

(Continued)

*Primary Examiner* — Rakesh Kumar
(74) *Attorney, Agent, or Firm* — Calfee, Halter & Griswold LLP

(57) ABSTRACT

Exemplary embodiments of wipes dispensers are disclosed herein. An exemplary wipes dispenser having a nozzle with a wear indicator includes a container, a plurality of wipes contained within the container, a fluid for wetting the plurality of wipes, a receiving member connected to the container, and an outlet nozzle housing for holding an elastomeric outlet nozzle. The elastomeric outlet nozzle includes a wear indictor that provides a visual indication that the nozzle should be replaced.

20 Claims, 8 Drawing Sheets

(56) References Cited

U.S. PATENT DOCUMENTS 5,215,211 A * 6/1993 Eberle ..... A47K 10/3818 221/281
5,310,083 A * 5/1994 Rizzuto ..... A47K 10/3818 221/312 R
5,322,031 A * 6/1994 Lerner ..... A61J 11/00 215/11.1
5,428,437 A * 6/1995 Carter ..... G03G 15/65 492/9
5,813,992 A * 9/1998 Henwood ..... G01K 13/25 600/528
5,980,668 A * 11/1999 Slingluff ..... B60C 11/24 152/DIG. 12
5,998,431 A * 12/1999 Tseng ..... A61K 8/8135 424/435
6,145,782 A * 11/2000 King ..... A47K 10/3818 242/593
6,786,153 B2 * 9/2004 Burrow ..... B41F 31/027 101/352.13
7,629,043 B2 * 12/2009 Lindsay ..... A47L 13/16 428/316.6
7,997,522 B2 * 8/2011 Titas ..... A47K 10/3818 242/615.3
8,857,614 B2 * 10/2014 Gordon ..... A47K 10/3818 221/63
9,101,250 B2 * 8/2015 Ray ..... B65D 83/0805
9,113,760 B2 * 8/2015 Knapp ..... A47K 10/3818
9,687,125 B2 * 6/2017 Marietta-Tondin ..... A47K 10/3818
9,962,045 B2 * 5/2018 Granger ..... A47K 10/3818
10,021,964 B2 * 7/2018 Brewer ..... A47K 7/04
10,292,545 B2 * 5/2019 Rodriguez ..... B65H 49/00
10,334,996 B2 * 7/2019 Tedesco ..... A47K 10/3818
10,562,500 B2 * 2/2020 Trebouet ..... B60S 1/4038
10,694,904 B2 * 6/2020 Gordon ..... B65D 83/0835
2002/0152565 A1 * 10/2002 Klupt ..... A61C 17/36 15/22.1
2005/0135979 A1 * 6/2005 Gootter ..... A61L 9/01 4/231
2005/0136238 A1 * 6/2005 Lindsay ..... A47L 13/16 428/317.1
2006/0229229 A1 * 10/2006 Bednarz ..... A47L 13/18 510/438
2008/0000562 A1 * 1/2008 Mohr ..... B60C 11/24 152/209.5
2015/0183405 A1 * 7/2015 Trebouet ..... B60S 1/3881 15/250.04
2017/0072119 A1 * 3/2017 Aalders ..... A61M 1/064
2018/0042432 A1 * 2/2018 Dansreau ..... A47K 10/3818
2020/0281421 A1 * 9/2020 Wolf ..... A47K 10/38

FOREIGN PATENT DOCUMENTS

GB 2285800 A * 7/1995 ..... B67D 7/005
WO WO-9413251 A1 * 6/1994 ..... A61J 11/00

OTHER PUBLICATIONS

International Search Report and Written Opinion from PCT/US20/20632 dated Jul. 21, 2020.

* cited by examiner

WIPES DISPENSING NOZZLES HAVING WEAR INDICATORS AND WIPES DISPENSERS HAVING THE SAME

TECHNICAL FIELD

The present application claims priority to, and the benefits of, U.S. Provisional Patent Application Ser. No. 62/814,990, titled WIPES DISPENSING NOZZLES HAVING WEAR INDICATORS AND WIPES DISPENSERS HAVING THE SAME, which was filed on Mar. 7, 2019, and which is incorporated by reference herein in its entirety.

TECHNICAL FIELD

The present invention generally relates to methods and systems for dispensing wipes or moist towelettes. More particularly, the present invention relates to wipes dispensing nozzles and dispensers having wipes dispensing nozzles.

BACKGROUND OF THE INVENTION

Wipes are typically made from a variety of materials, such as non-woven materials. Wipes are often moistened with solutions, such as cleaning solutions and or antimicrobial solutions. The wipes may be stacked and folded in a container or may be in the form of a roll. Wipes in the form of a roll typically have perforations between the wipes. The strength of the material between the two wipes is critical. It needs to be strong enough sot the wipes remain attached to one another until the top of the trailing wipe is pulled up through a dispensing outlet nozzle and weak enough to break when the leading tail of the second wipe is high enough above the outlet nozzle that it may be grabbed by a user and pulled out of the container when another wipe is required. However, often the lead tail does not extend high enough past the opening for a user to grab, which leads to customer "short tail" complaints. In addition, the strength of the material between the two wipes must be weak enough so that when the leading edge of the wipe is sufficiently above the outlet nozzle, the material breaks. When it does not break, "roping" occurs and multiple wipes are pulled out of the nozzle, when only one was required. Use of a softer resilient material, such as, for example, silicon rubber, has been found to overcome the deficiencies identified above, however, the softer resilient material may wear overtime and allow roping to occur.

SUMMARY

Exemplary embodiments of wipes dispensers are disclosed herein. An exemplary wipes dispenser includes a container for holding a plurality of wipes and an outlet nozzle secured to the container. The outlet nozzle comprises an elastomeric member. The outlet nozzle includes an aperture for the wipes to be pulled through. A wear indicator is located proximate the aperture. The wear indicator is used to provide an indication that the nozzle should be replaced.

Another exemplary wipes dispenser includes a container, a plurality of wipes contained within the container, a fluid for wetting the plurality of wipes and a self-orientating outlet nozzle with wear indicator. The self-orientating outlet nozzle includes a moveable outlet opening. The moveable outlet opening aligns with the direction of pull of the wipe when the wipe is pulled out of the dispenser at an angle that is not substantially vertical.

Another exemplary embodiment of a wipes dispenser includes a container for holding a plurality of wipes and a self-orientating outlet nozzle secured to the container. The self-orientating nozzle has a housing that has a partial spherical shape. A resilient member having an outlet opening and a wear indicator is secured to the housing. The exemplary embodiment further includes a socket for receiving the housing. At least a portion of the housing can rotate within the socket.

Another exemplary wipes dispenser having self-orientating outlet nozzle includes a container for holding a plurality of wipes and a liquid for wetting the wipes and a self-orientating outlet nozzle with wear indicator. The self-orientating outlet nozzle has an outlet opening. A connector for connecting the self-orientating outlet nozzle to the container is also included. The connector is configured so that the outlet of the self-orientating outlet nozzle is moveable with respect to the container and moves so that the opening is aligned with a wipe pull direction when the wipe pull direction is offset from a vertical position.

Another exemplary dispenser for dispensing wipes includes a container, a cap, a plurality of wipes contained within the container, a socket, a housing located at least partially within the socket and an elastomeric outlet nozzle with a wear indicator is secured to the housing. The elastomeric outlet nozzle has an outlet opening and the housing is configured to self-orientating within the socket.

Another exemplary wipes dispenser includes a container for holding a plurality of wipes and a dispensing self-orientating nozzle secured to the container. The dispensing self-orientating nozzle includes a housing having a partial spherical shape and a resilient member with a wear indicator having an outlet opening secured to the housing. The dispenser includes a socket for receiving the housing of the dispensing self-orientating nozzle.

Another exemplary dispensing self-orientating nozzle for wipes includes a resilient dome shaped member with a wear indicator, an outlet opening located in the dome shaped member, and a housing having a partial spherical shape. The housing is configured to be received in a socket allowing the outlet opening to self-orientating.

An exemplary wipes dispenser having a self-centering nozzle includes a container, a plurality of wipes contained within the container, a fluid for wetting the plurality of wipes, a receiving member connected to the container, and an outlet nozzle housing for holding an elastomeric outlet nozzle with a wear indicator. The nozzle housing is connected to the receiving member so that the nozzle housing is movable between two or more positions. A biasing member is connected to one of the receiving member, the nozzle housing and the elastomeric outlet nozzle. The elastomeric outlet nozzle moves from a centered upright position, the biasing member deflects and biases the outlet nozzle toward a centered position.

Another exemplary wipes dispenser includes a container for holding a plurality of wipes. The dispenser includes an outlet nozzle secured to the container. The outlet nozzle includes an elastomeric member. The elastomeric member has an aperture configured to allow wipes to be pulled therethrough. A wear indicator is located proximate the aperture. The wear indicator at least partially surrounds the aperture. The aperture is configured to wear away after a plurality of wipes are pulled through the aperture and the wear indicator is configured to provide an indication that the nozzle should be replaced.

Another exemplary wipes dispenser includes a container for holding a plurality of wipes, and an nozzle holder secured to the container. An outlet nozzle is retained by the nozzle holder. The outlet nozzle is configured to rotate with respect to the nozzle holder. The outlet nozzle includes an elastomeric member. The outlet nozzle has an aperture for wipes to be pulled therethrough. A wear indicator at least partially surrounding the aperture. After a plurality of wipes are pulled through the aperture wears and the opening of the aperture widens. After the aperture widens, at least a portion of the aperture is closer to an edge of the wear indicator than it was prior to the plurality of wipes being pulled through the aperture.

Another exemplary wipes dispenser includes a container for holding a plurality of wipes and an outlet nozzle. The outlet nozzle includes an elastomeric member. The elastomeric member includes an opening. A wear indicator is located at least partially around the opening. The wear indicator provides a visual reference that indicates that the opening has enlarged and the elastomeric member needs to be replaced.

BRIEF DESCRIPTION OF THE DRAWINGS

These and other features and advantages of the present invention will become better understood with regard to the following description, and accompanying drawings where.

DETAILED DESCRIPTION

Figure 1:
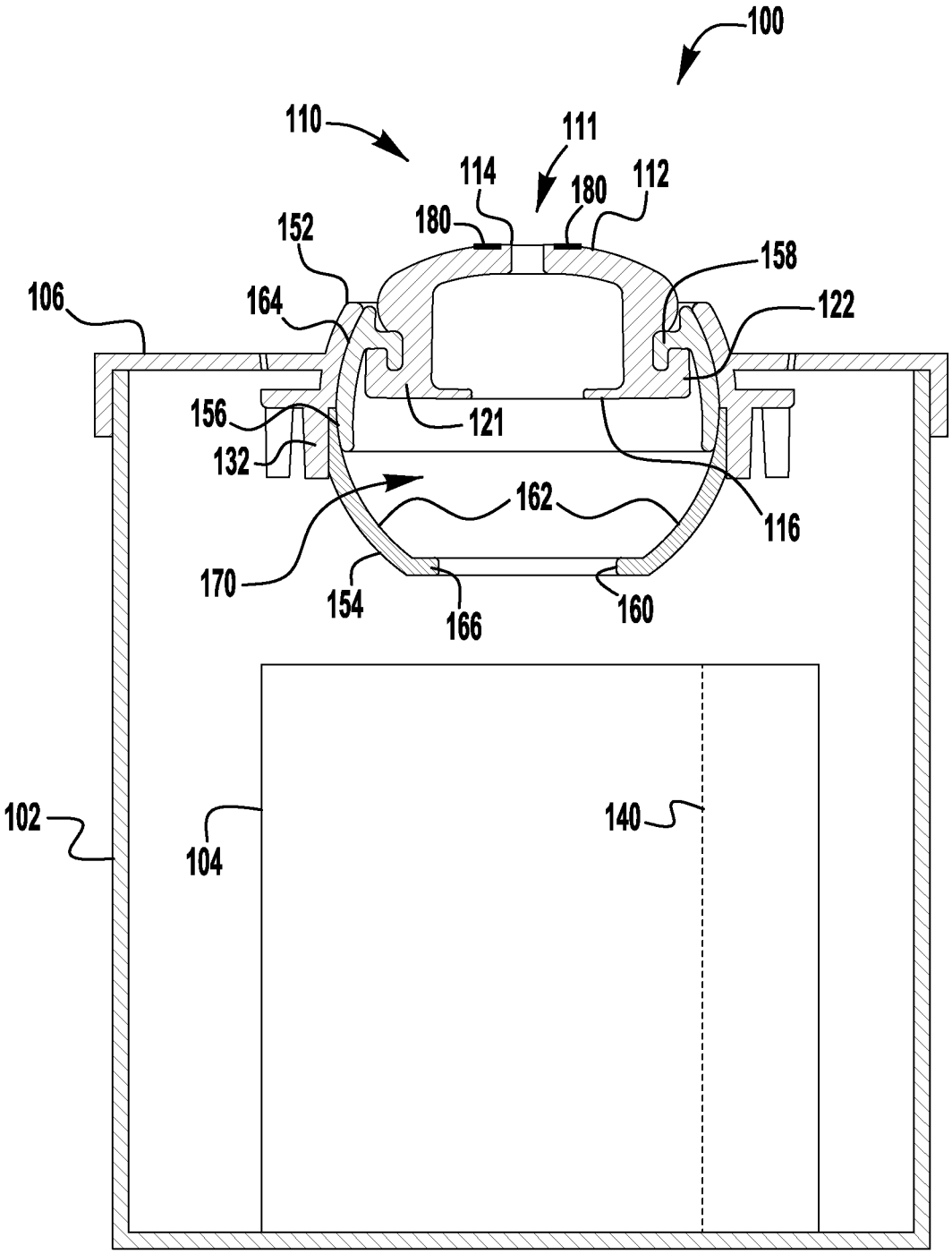
FIG. 1 is a cross-sectional view of an exemplary embodiment of a wipes dispenser having a self-orientating nozzle having a wear indicator with the self-orientating nozzle in an upright position.
Figure 2:
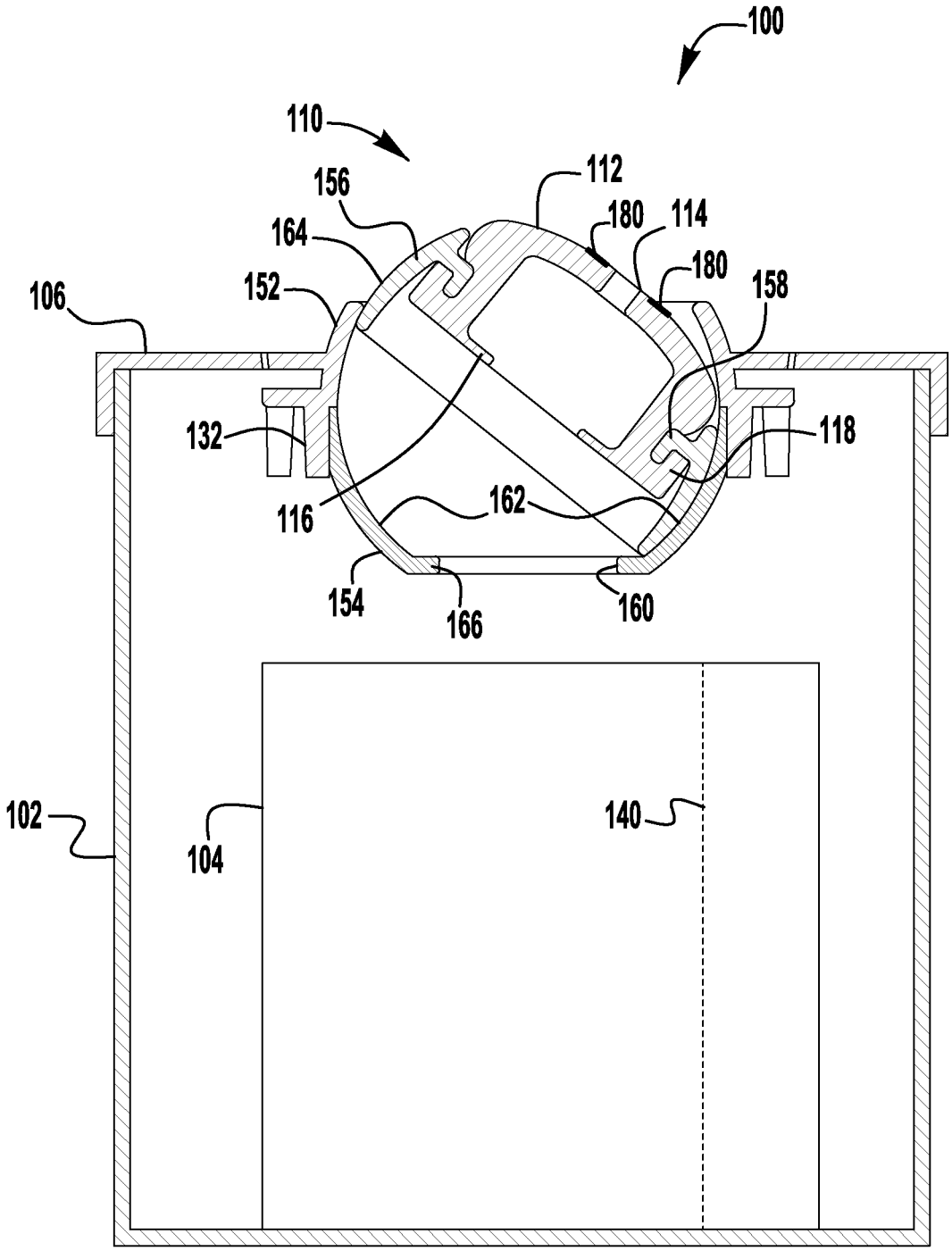
FIG. 2 is a cross-sectional view of an exemplary embodiment of the wipes dispenser of FIG. 1 with the self-orientating nozzle in an oriented position.

FIGS. 1 and 2 illustrate an exemplary embodiment of a wipes dispenser 100. Wipes dispenser 100 includes a container 102. Located inside of container 102 is a roll of wipes 104. In this exemplary embodiment, the role of wipes 104 has periodic perforations 140 that separate individual wipes and provide tear points that separate the wipe from the role of wipes. In some embodiments, the wipes 104 are individual wipes that are folded together in a manner such that the leading wipe pulls the trailing wipe through the opening before the two wipes separate. Wipes dispenser 100 includes a cap 106 secured to container 102. Cap 106 may be secured to container 102 by any means such as, for example, a threaded connection, a welded connection, a snap-fit connection, an adhesive bonding connection, a friction fit, or the like.

In this exemplary embodiment, cap 106 includes an opening 132 formed by cap projection member 152. Cap projection member 152 has a partial spherical shape. A lower member 154 is secured to cap projection member 152. Lower member 154 may be secured to projection member 152 by any means, such as, for example, a threaded fit, a friction fit, an adhesive connection, a snap fit, and the like. Lower projection member 154 also has a partial spherical shape. Cap projection member 152 and lower member 154 form a socket 170 having spherical shaped inside walls 162. Socket 170 includes an opening 160 located in the bottom of the socket 170 to allow wipes to be pulled up through the socket 170 and out of the opening 114 in outlet nozzle 111 of self-orientating outlet 110. Also located at the bottom of socket 170 is annular projection 166 that limits the travel of the self-orientating outlet nozzle holder 110.

Located within socket 170 is self-orientating nozzle housing 156, which also has a partial spherical shape, and forms a portion of a ball 164 that may rotate and self-orientate within socket 170. Annular projection 166 prevents self-orientating outlet nozzle holder 110 from rotating to far, e.g. from rotating to a point where opening 114 is no longer within opening 132 when self-orientating outlet housing 156 contacts the annular projection 166.

Self-orientating outlet housing 156 includes an annular projection 158. Annular projection 158 retains an elastomeric or resilient outlet nozzle 111 in the self-orientating nozzle housing 156. The elastomeric or resilient outlet nozzle 111 may be made of, for example, silicon, an elastomer, rubber, plastic, TPE, or the like.

In some embodiments, elastomeric or resilient outlet nozzle 111 is mounted to the cap without the self-orientating nozzle.

In this exemplary embodiment, outlet nozzle 111 includes a dome 112 that has a narrow aperture or opening 114 therethrough. In some embodiments, opening 114 has a circular cross-section that may expand as needed to allow a wipe 302 (FIG. 3) to be pulled through the opening 114. In all of the embodiments disclosed herein, the openings are shown as round, however, the openings may be different cross-sectional shapes such as, for example, oval, rectangular, multi-faceted, star shapes, conical shapes, polygonal shapes and the like. In some embodiments, the thickness of the opening may be adjusted to achieve a desired resistance that is placed on the wipes as they are pulled through. The desired resistance may be selected to ensure that the trailing wipes separate from the lead wipes and that the lead end of the trailing wipe extend above the top of the outlet nozzle 111.

In this exemplary embodiment, self-orientating outlet nozzle holder 110 includes an optional fluid retaining member 120. Fluid retaining member 120 is an annular member that has a non-sloped, horizontal surface. In some embodiments, the surface may be sloped upward. In some embodiment, the horizontal surface 120 traps and holds liquid. As shown, fluid retaining member 120 is integrally molded with dome 112; however, fluid retaining member 120 may optionally be a separate piece. Outlet nozzle 111 has an annular projection 121 below the dome 112. The annular projection 121 has an upwardly extending flange 122 on an outer end to connect to annular projection 158 of the self-orientating outlet housing 156.

Outlet nozzle 111 includes a wear indicator 180. Wear indictor 180 is used to inform a user that outlet nozzle 111 needs to be replaced. Outlet nozzle 111 needs to be periodically replaced because as wipes are pulled through the elastomeric or rubber outlet nozzle 111, the opening 114 tends to wear and increase in size. After a period of use, the opening 114 may become oversized and roping occurs when a user pulls on the lead wipe. Roping is when the wipes do not separate from one another and multiple wipes pull out of the container 102.

Often times users do not know that the outlet nozzle 111 wears and needs replaced periodically. The exemplary wear indicator 180 of outlet nozzle 111 provides a visual indication of when the outlet nozzle 111 needs to be replaced. In this exemplary embodiment, wear indicator 180 at least partially surrounds the opening 114. As opening 114 wears the opening approaches wear indictor 180. When the opening reaches wear indicator 180, the outlet nozzle 111 needs to be replaced. In some exemplary emblements, wear indicator 180 is a different color than the surrounding part of the dome 112. In some embodiments, wear indicator 180 is printed on the surface of the dome 112. In some embodiments, wear indicator 180 is made of a different material than the dome 112. In some embodiments, wear indicator 180 is an over-mold on the dome 112. In some embodiments, the over-molding is a different color. In some embodiments, the over-molding has a different texture. In some embodiments, wear indicator 180 is a raised portion around opening 114. In some embodiments, wear indicator 180 is a lower portion around opening 114. In some embodiments, wear indicator 180 surrounds the opening 114 and when the wear indicator 180, or a portion thereof, is worn through or off, a user can readily determine that the outlet nozzle 110 needs to be replaced.

Figure 3:
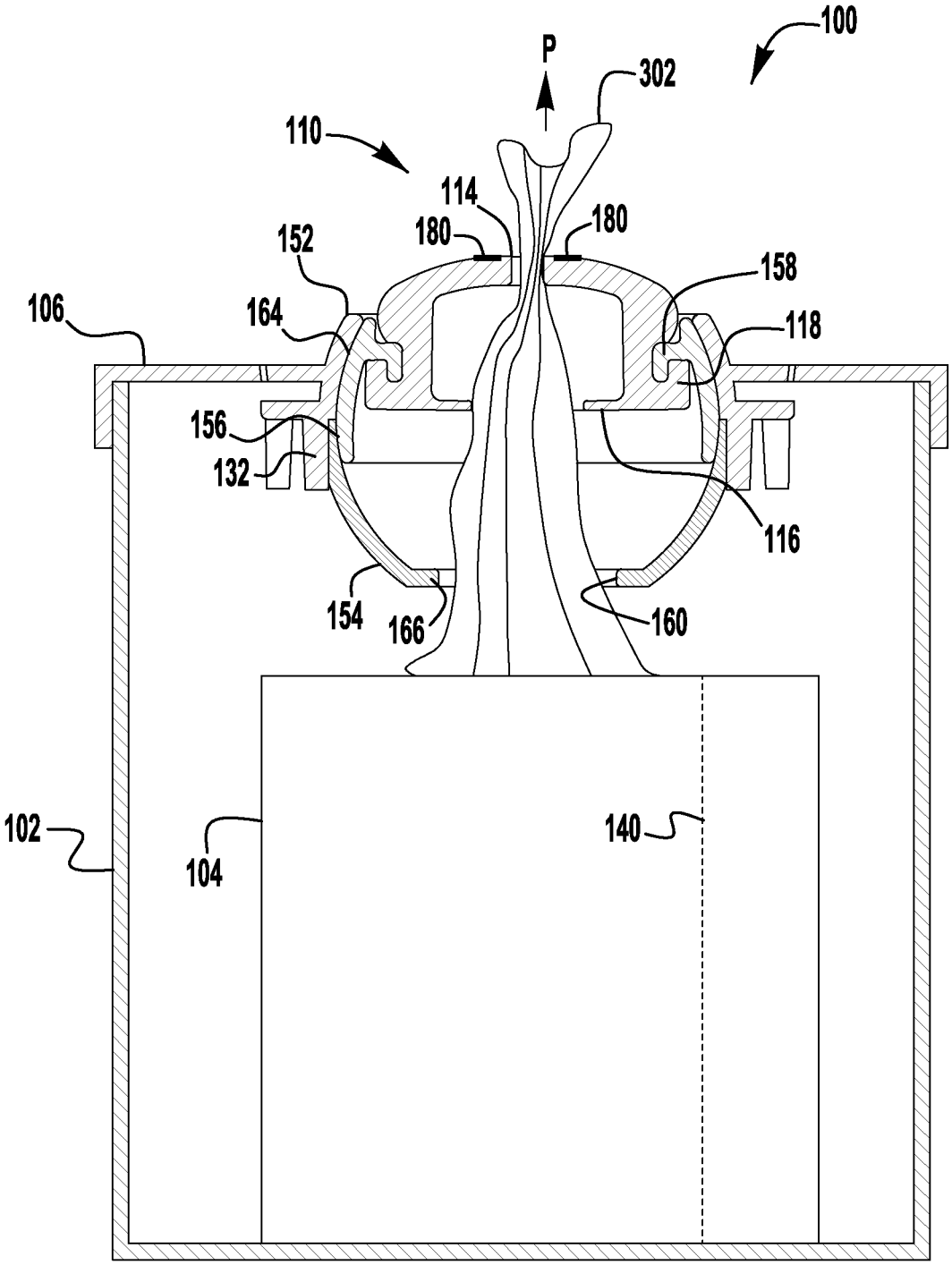
FIG. 3 is a cross-sectional view of the exemplary embodiment of a wipes dispenser of FIG. 1 having the self-orientating nozzle in an upright position with a wipe extending through the nozzle.
Figure 4:
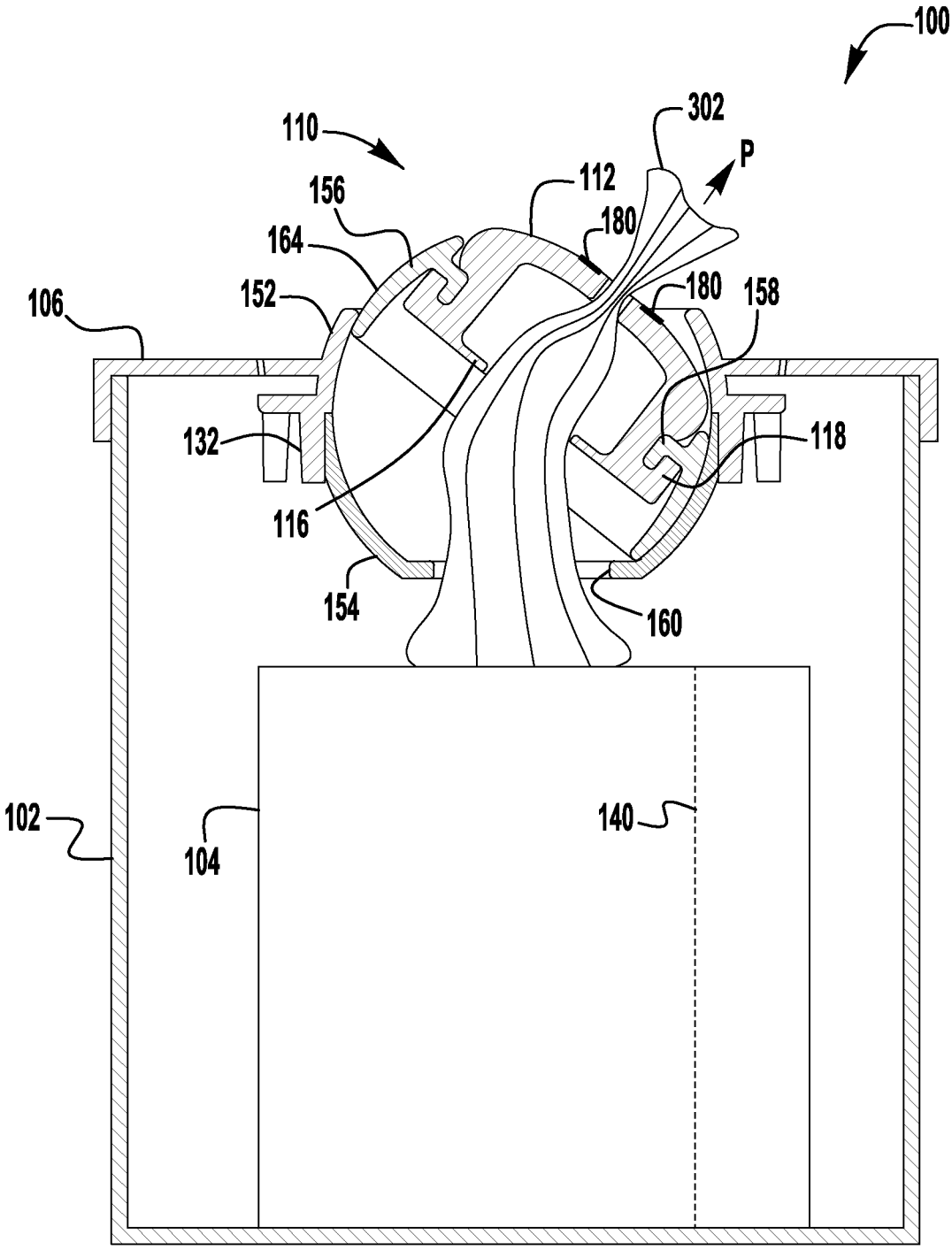
FIG. 4 illustrates a cross-sectional view of an exemplary embodiment of a wipes dispenser of FIG. 1 having the self-orientating nozzle in an oriented position with a wipe extending through the nozzle.

FIGS. 3 and 4 illustrate the exemplary dispenser 100 having a wipe 302 pulled up through opening 114 in an upward direction (FIG. 3) and also in a non-vertical direction (FIG. 4). During operation, wipe 302 is pulled up through self-orientating outlet nozzle holder 110. As wipe 302 is pulled up through narrow opening 114 of outlet nozzle 111, liquid is squeezed or rung out of the wipe 302. The liquid travels along the inside of dome 112 and runs down to fluid retaining member 120. The liquid contacts a portion of the wipe 302 that is passing by fluid retaining member 120 to re-wet the wipe 302. Thus, fluid retaining member 120 helps ensure that all of the wipe 302 is wet. In addition, fluid retaining member 120 may hold liquid for a longer period of time and help keep the wipe 302 from drying out between uses. In some embodiments, fluid retaining member 120 and the size of opening 114 combine to eliminate the need for a re-closable cover (not shown) to be disposed over outlet nozzle 111 and supporting ring 150.

In addition, during operation when wipe 302 is pulled out of the outlet nozzle 111, the self-orientating outlet nozzle holder 110 is free to rotate or swivel in socket 170. Accordingly, the opening 114 of outlet nozzle 111 aligns with the direction of pull (P). FIG. 3 illustrates how the self-orientating outlet nozzle holder 110 aligns when the direction of pull (P) is upward. FIG. 4 illustrates how the self-orientating outlet nozzle holder 110 aligns when the direction of pull (P) is off to the side.

It has been discovered that when the self-orientating outlet nozzle holder 110 aligns with the direction of pull, the number of short tails, i.e. the leading edge of the wipe not being far enough out of the opening 114 for a user to be able to grab hold of to pull the wipe out of the container is reduced.

Figure 4A:
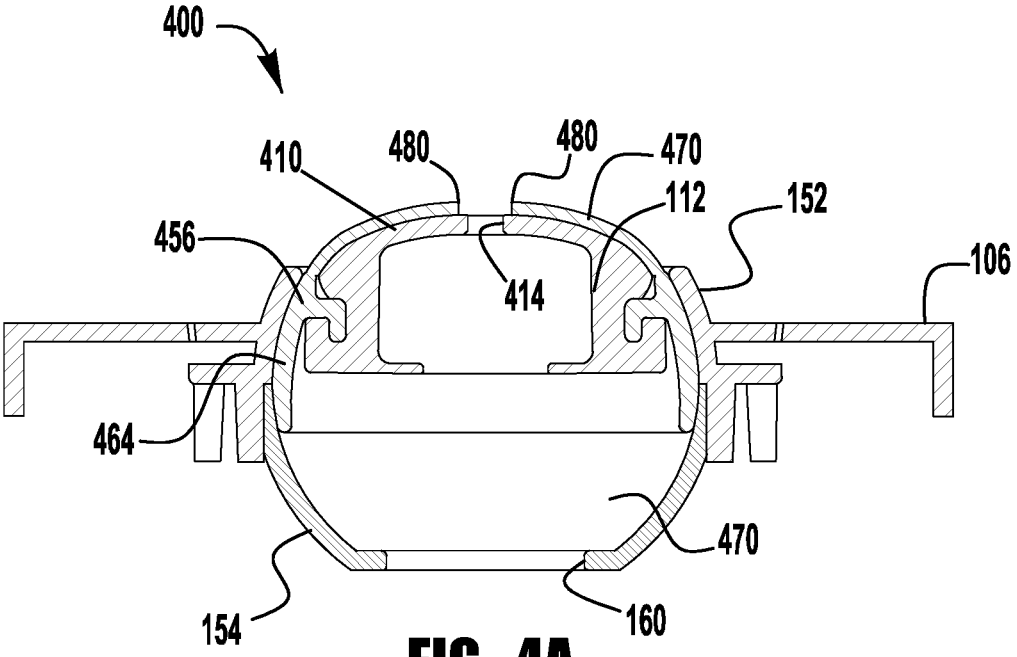
FIG. 4A illustrates a cross-sectional view of another exemplary embodiment of a wipes dispenser having a self-orientating nozzle and a wear indicator.

FIG. 4A is cross-sectional view of another exemplary embodiment of a self-orientating outlet 400 having a wear indicator 480. Self-orientating outlet nozzle holder 400 includes cap 106 that includes an opening 132 formed by cap projection member 152. Cap projection member 152 has a partial spherical shape. A lower member 154 is secured to cap projection member 152. Lower member 154 may be secured to projection member 152 by any means, such as, for example, a threaded fit, a friction fit, an adhesive connection, a snap fit, and the like. Lower projection member 154 also has a partial spherical shape. Cap projection member 152 and lower member 154 form a socket 470 having spherical shaped inside walls and form an opening 160 located in the bottom of the socket 470 to allow wipes to be pulled up through the socket 470. Located within socket 470 is self-orientating outlet housing 456, which also has a partial spherical shape, and forms a portion of a ball 464 that may rotate and self-orientate within the socket formed by projection member 152 and lower projection member 154.

Self-orientating outlet housing 400 includes an upper surface member 470 that encircles outlet nozzle 410 and has an opening located above and around opening 414 in outlet nozzle 410. The opening in upper surface member 470 is an exemplary wear indicator 480. When the opening 414 wears and reaches upper surface member 470, a user knows that it is time to replace the outlet nozzle 410. In this exemplary embodiment, upper surface member 470 is a semi-rigid material, such as for example, plastic, that surrounds the opening. In some embodiments, wear indicator 480 is an opening that is configured to prevent and/or slow down wear of the opening 414 when the opening wears enough to reach wear indicator 480. Thus, in some exemplary embodiments, wear indicator 480 provides an indication that the nozzle 410 needs to be replaced and also helps to prevent roping of the wipes from occurring and/or from becoming worse until the nozzle 410 is replaced.

Figure 5:
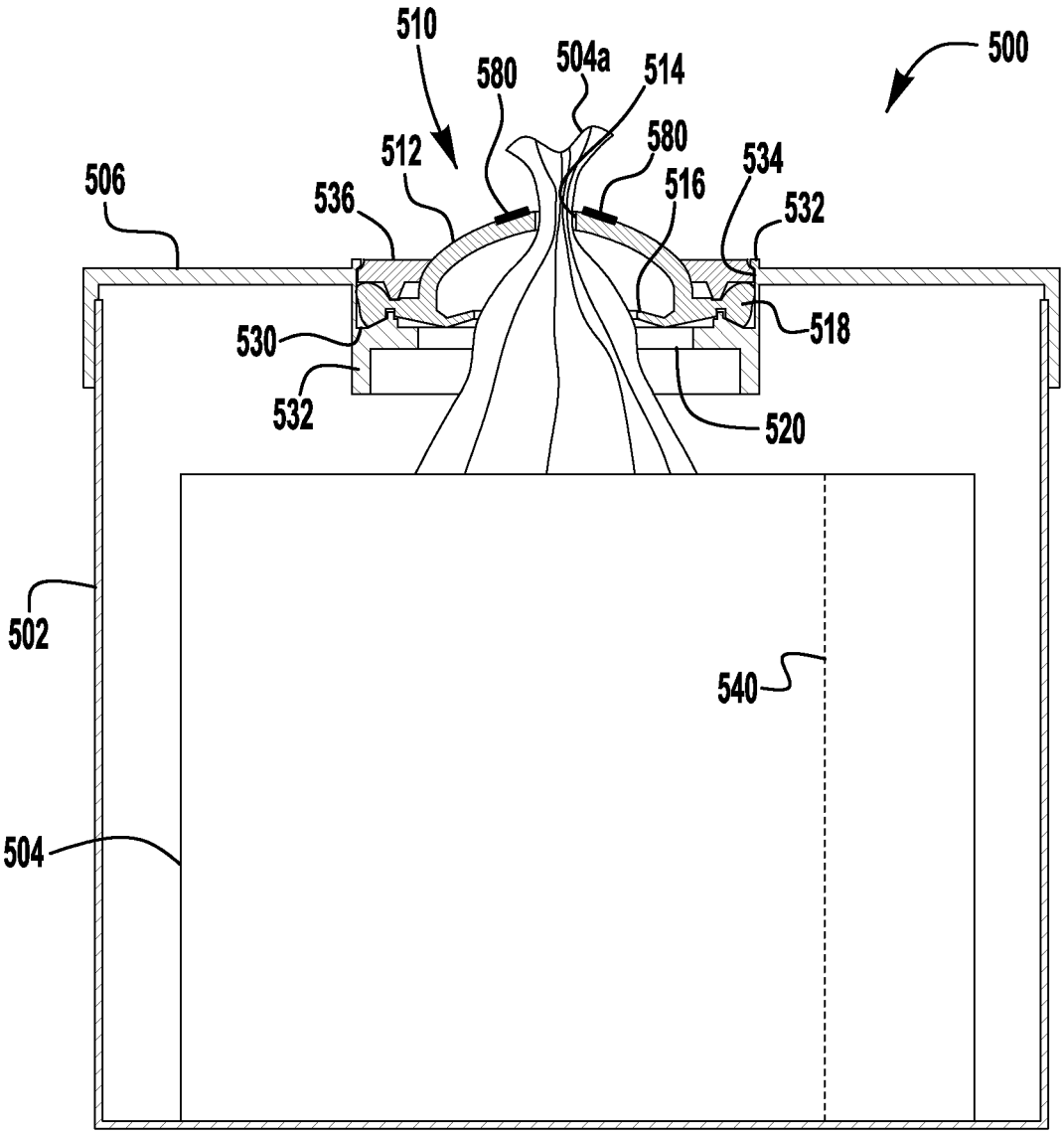
FIG. 5 is another exemplary embodiment of wipes dispenser and nozzle having a wear indicator.

FIG. 5 illustrates an exemplary embodiment of a wet wipes dispenser 500 with an outlet nozzle 510. Outlet nozzle 510 is stationary and does not rotate when a wipe is pulled therethrough. Wipes dispenser 500 includes a container 502. Located inside of container 502 is a roll of wipes 504. The role of wipes 504 has periodic perforations 540 that are used to separate individual wipes from the role of wipes. In one embodiment, the wipes are individual wipes that are folded together such that the leading wipe pulls the trailing wipe through the opening before the two wipes separate. Wipes dispenser 500 includes a cap 506 secured to container 502. Cap 506 may be secured to container 502 by any means such as, for example, a threaded connection, a welded connection, a snap-fit connection, an adhesive bonding connection or the like.

Cap 506 includes a recessed portion 532 that has an aperture 520 to allow wipes 104*a* to pass therethrough. In addition, recessed portion 132 has a support ledge 530. Support ledge 530 supports an annular projection 518 of a dispensing nozzle 510.

Dispensing nozzle 510 is made of a resilient material such as, for example, silicon. Dispensing nozzle 510 includes a dome 512 that has a narrow aperture or opening 514 therethrough. Opening 514 has a circular cross-section that may expand as needed to allow the wipe 504*a* to be pulled through the opening 514. Nozzle 510 includes a fluid retaining member 516. Fluid retaining member 516 is an annular member that has a sloped surface. In one embodiment, the sloped surface traps and holds liquid. As shown, fluid retaining member 516 is integrally molded with dome 512; however, fluid retaining member 516 may optionally be a separate part.

In addition, nozzle 510 includes a wear indicator 580. Wear indictor 580 is used to inform a user that nozzle 510 needs to be replaced. Nozzle 510 needs to be periodically replaced because as wipes are pulled through the elastomeric or rubber member, the opening 514 tends to wear. After a period of use, the opening 514 may become oversized allowing roping occur. The exemplary nozzle 510 includes a wear indicator 580 that provides an indication of when the nozzle 510 needs to be replaced. In this exemplary embodiment, wear indicator 080 at least partially surrounds the opening 014 and may be made of a different material than nozzle 512. As opening 514 wears, the opening approaches wear indictor 580. When the opening reaches wear indicator 580, the nozzle 510 needs to be replaced. In some exemplary emblements, wear indicator 580 is a different color than the surrounding part of the dome 512. In some embodiments, wear indicator 580 is printed on the surface of the dome 512. In some embodiments, wear indicator 580 is made of a different material than the dome 512. In some embodiments, wear indicator 580 is an over-mold on the dome 512. In some embodiments, the over-molding is a different color. In some embodiments, the over-molding has a different texture. In some embodiments, wear indicator 580 is a raised portion around opening 514. In some embodiments, wear indicator 580 is a lower portion around opening 514. In some embodiments, wear indicator 580 surrounds the opening 514 and when the wear indicator 580 is worn through or off, a user can readily determine that the outlet nozzle 110 needs to be replaced.

Wipes dispenser 500 may include a retaining ring 536. Retaining ring 536 secures dispensing nozzle 510 to cap 506. Retaining ring 536 is retained with a snap-fit connection by projection 532 on cap 506 and projection 534 on retaining ring 536.

During operation, wipe 504*a* is pulled up through dispensing nozzle 510. As wipe 504*a* is pulled up through narrow opening 514 of dispensing nozzle 510, liquid is squeezed or rung out of the wipe 504. The liquid travels along the inside of dome 512 and runs down to fluid retaining member 516. The liquid contacts a portion of the wipe 504*a* that is passing by fluid retaining member 516 to re-wet the wipe 504*a*. Thus, fluid retaining member 516 helps ensure that all of the wipe 504*a* is wet. In addition, fluid retaining member 516 may hold liquid for a longer period of time and help keep the wipe 504*a* from drying out between uses. In one embodiment, fluid retaining member 516 and the size of opening 514 combine to eliminate the need for a re-closable cover (not shown) on cap 506.

In addition, during operation when a wipe is pulled through an orifice, liquid is often expelled from the wipe in the form of a spray, especially when the wipe is pulled from the container rapidly. In one embodiment, fluid retaining member 516 prevents the expelled liquid from spraying.

Although the embodiments illustrated herein have a dome shape, other shapes are contemplated such as, for example, a conical shape. In addition, fluid retaining member 516 may have shapes that are not annular. In one exemplary embodiment, the opening of fluid retaining member 516 is a longitudinal slit. In another, the opening of fluid retaining member 116 has a star shape. Other optional shapes include polygonal openings and sinusoidal slits.

Figure 6:
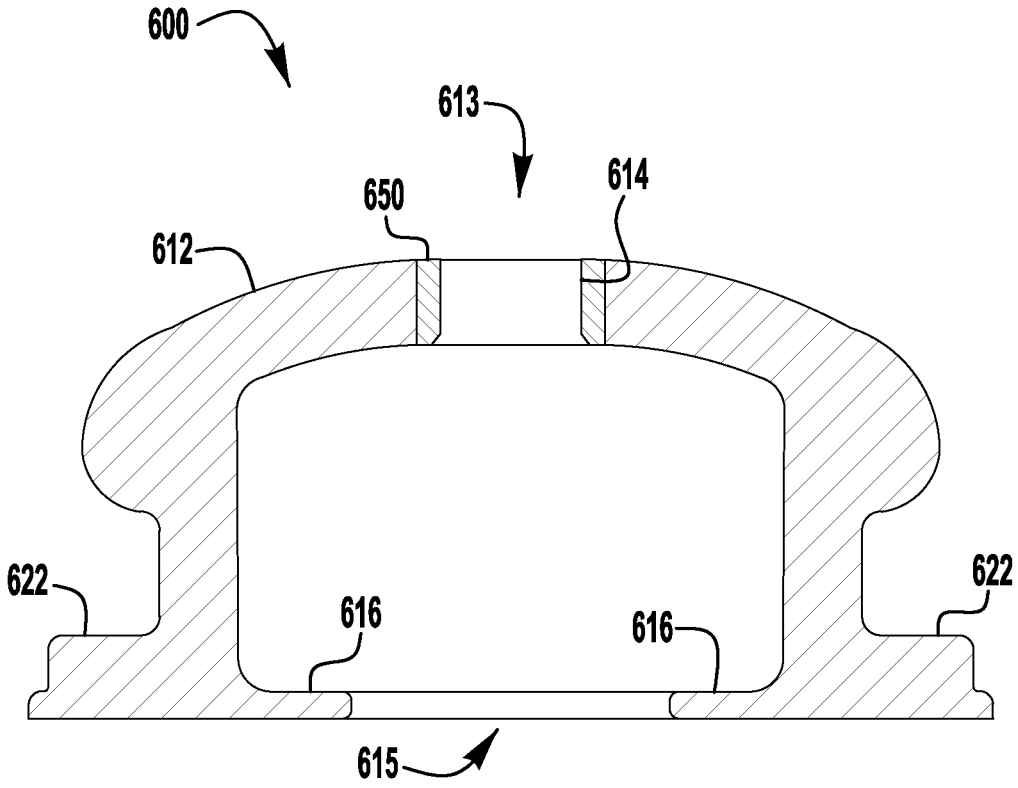
FIG. 6 is another exemplary embodiment of a nozzle having a wear indicator.

FIG. 6 is another exemplary embodiment of an elastomeric or resilient outlet nozzle member 600. The elastomeric or resilient outlet nozzle member 600 may be made of, for example, silicon, an elastomer, rubber, plastic, TPE, or the like.

In this exemplary embodiment, outlet nozzle member 600 includes a dome 612 that has a narrow aperture 614 that forms an opening 613 therethrough. In some embodiments, opening 613 has a circular cross-section that may expand as needed to allow a wipe (not shown) to be pulled through the opening 613. In all of the embodiments disclosed herein, the openings are shown as round, however, the openings may be different cross-sectional shapes such as, for example, oval, rectangular, multi-faceted, star shapes, conical shapes, polygonal shapes and the like. In some embodiments, the thickness of the opening may be adjusted to achieve the desired resistance placed on the wipes as they are pulled through.

In this exemplary embodiment, outlet nozzle 600 includes an optional fluid retaining member 616. Fluid retaining member 616 is an annular member that has a non-sloped, horizontal surface. In some embodiments, the surface may be sloped upward. In some embodiment, the horizontal surface 616 traps and holds liquid. As shown, fluid retaining member 616 is integrally molded with dome 612; however, fluid retaining member 616 may optionally be a separate piece. Outlet nozzle 600 has an annular projection 622 below the dome 612.

As wipes are pulled through the elastomeric or rubber member, the opening 613 tends to wear. After a period of use, the opening 613 wears and becomes too large. When this happens, issues such as, for example, roping occur. Roping is when the wipes do not separate from one another and multiple wipes pull out of the container. Most users do not know that the outlet nozzle 600 wears and needs replaced periodically. The exemplary outlet nozzle 600 includes a wear indicator 650 that provides an indication of when the outlet nozzle 600 needs to be replaced. In some embodiments, wear indicator 650 is a different color than the surrounding part of the dome 612. In this exemplary embodiment, wear indicator 650 extends along the depth of the opening 614. In some embodiments, 650 wear indicator is printed on the surface of the dome. In some embodiments, wear indicator is made of a different material than the dome 612. In some embodiments, wear indicator 650 is over-molded on dome 612. In some embodiments, the over-molding is a different color. In some embodiments, the over-molding has a different texture. In some embodiments, wear indicator 650 is a raised portion around opening 613. In some embodiments, wear indicator 650 is a lower portion around opening 613. When the wear indicator 650 is worn through or off, a user can readily determine that the nozzle 600 needs to be replaced.

Figure 7:
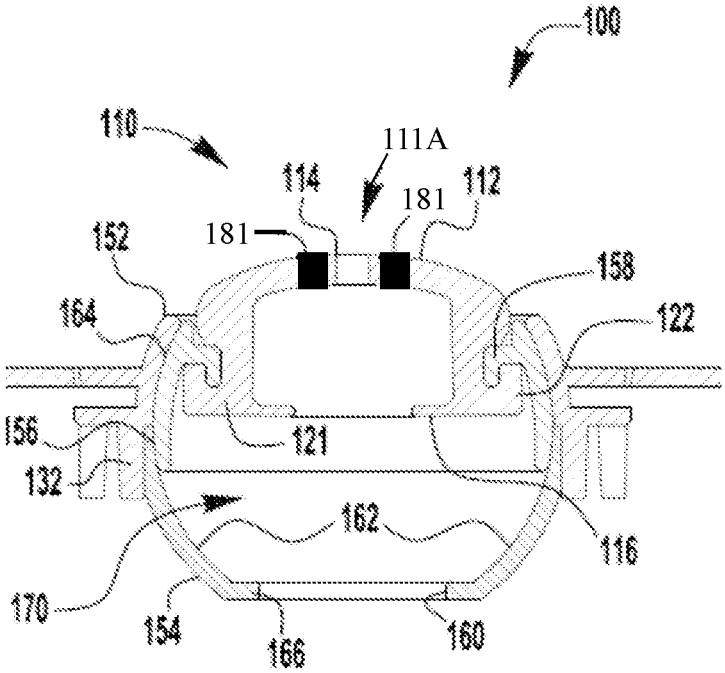
FIG. 7 is another exemplary embodiment of a portion of a nozzle having a wear indicator, wherein the wear indicator is thicker than the material surrounding the wear indictor.
Figure 8:
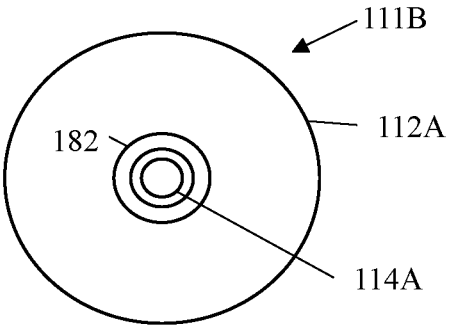
FIG. 8 is another exemplary embodiment of a portion of a nozzle having a wear indicator, wherein the wear indicator has a round shape.
Figure 9:
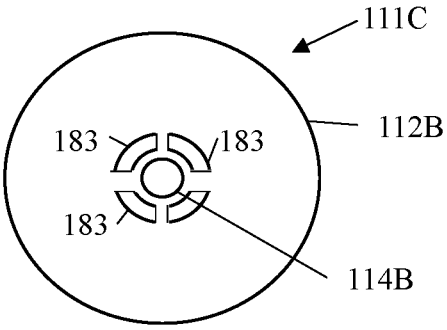
FIG. 9 is another exemplary embodiment of a portion of a nozzle having a wear indicator, wherein the wear indicator at least partially surrounds the opening.

FIG. 7 is another exemplary embodiment of a portion of an outlet nozzle 111A having an opening 114A and a wear indicator 181, wherein the wear indicator 181 is thicker than the material surrounding the wear indictor 181. FIG. 8 is another exemplary embodiment of a portion of an outlet nozzle 111B in the form of an elastomeric dome 112A having a wear indicator 182, wherein the wear indicator has a round shape. FIG. 9 is another exemplary embodiment of a portion of an outlet nozzle 111C in the form of an elastomeric dome 112B having a wear indicator 183, wherein the wear indicator at least partially surrounds the opening 114B.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. For example, the fluid retaining member may be separate from the dome self-orientating nozzle. Therefore, the invention, in its broader aspects, is not limited to the specific details, the representative apparatus and illustrative examples shown and described. Accordingly, departures may be made from such details without departing from the spirit or scope of the applicant's general inventive concept.

We claim:

1. A wipes dispenser comprising:
a container for holding a plurality of wipes; and
an outlet nozzle secured to the container;
the outlet nozzle comprises
an elastomeric member;
an aperture is located in the elastomeric member for wipes to be pulled through;
a wear indicator located proximate the aperture;
wherein the wear indicator at least partially surrounds the aperture;
wherein the aperture wears due to frictional forces and expands in size after a plurality of wipes are pulled through the aperture; and
wherein the wear indicator is configured to provide a visual indication that the aperture has expanded and the outlet nozzle should be replace;
wherein the visual indication is that at least a portion of the aperture has expanded to one of a) to the wear indicator or b) through at least a portion of the wear indicator.

2. The wipes dispenser of claim 1 wherein the wear indicator is a different color than an area surrounding the wear indicator.

3. The wipes dispenser of claim 1 wherein the wear indicator is thicker than a thickness of the material surrounding the wear indicator.

4. The wipes dispenser of claim 1 wherein the wear indicator is molded on top of the outlet nozzle base material.

5. The wipes dispenser of claim 1 wherein the wear indicator has a round shape.

6. The wipes dispenser of claim 1 wherein the wear indicator is printed on the outlet nozzle.

7. The wipes dispenser of claim 1 wherein the wear indicator is a different material than the outlet nozzle.

8. The wipes dispenser of claim 1 wherein the wear indicator extends entirely around the perimeter of the aperture.

9. A wipes dispenser comprising:
a container for holding a plurality of wipes;
a nozzle holder secured to the container; and
an outlet nozzle retained by the nozzle holder;
the outlet nozzle configured to rotate with respect to the nozzle holder;
the outlet nozzle comprising an elastomeric member;
the outlet nozzle having an aperture for wipes to be pulled through;
a wear indicator at least partially surrounding the aperture;
wherein the wear indicator is configured to provide a visual indication that the nozzle opening has increased in size and the nozzle needs to be replaced;
wherein the visual indication is that at least a portion of the aperture contacts an edge of the wear indicator.

10. The wipes dispenser of claim 9 wherein the wear indicator is a different color than an area surrounding the wear indicator.

11. The wipes dispenser of claim 9 wherein the wear indicator is thicker than a thickness of the material surrounding the wear indicator.

12. The wipes dispenser of claim 9 wherein the wear indicator is molded on top of the outlet nozzle base material.

13. The wipes dispenser of claim 9 wherein the wear indicator is printed on the nozzle.

14. The wipes dispenser of claim 9 wherein the wear indicator is a different material than the outlet nozzle.

15. A wipes dispenser comprising:
a container for holding a plurality of wipes; and
an outlet nozzle;
the outlet nozzle comprises
an elastomeric member;
an opening in the elastomeric member;
a wear indicator located at least partially around the opening;
wherein the wear indicator is configured to provide a visual indication that the nozzle opening has increased in size and the nozzle needs to be replaced;
wherein the visual indication is that the opening has enlarged to or through the wear indicator.

16. The wipes dispenser of claim 15 wherein the wear indicator is a different color than the area surrounding the wear indicator.

17. The wipes dispenser of claim 5 wherein the wear indicator is thicker than the thickness of the material surrounding the wear indicator.

18. The wipes dispenser of claim 15 wherein the wear indicator is over-molded on the nozzle.

19. The wipes dispenser of claim 15 wherein the wear indicator is a different material than the outlet nozzle.

20. The wipes dispenser of claim 15 wherein the different material slows down wear of the outlet nozzle.

* * * * *